US007540067B2

(12) United States Patent
Colbourne et al.

(10) Patent No.: US 7,540,067 B2
(45) Date of Patent: Jun. 2, 2009

(54) FASTENER FOR FIXING AN EDGE PORTION OF A RESILIENT MATERIAL TO A SURFACE

(75) Inventors: Benjamin Colbourne, West Sussex (GB); Keith Colbourne, West Sussex (GB); Peter Bailey, West Sussex (GB)

(73) Assignee: Minsell Services Limited (GB)

( * ) Notice: Subject to any disclaimer, the term of this patent is extended or adjusted under 35 U.S.C. 154(b) by 149 days.

(21) Appl. No.: 11/660,716

(22) PCT Filed: Sep. 8, 2005

(86) PCT No.: PCT/GB2005/003462

§ 371 (c)(1),
(2), (4) Date: Feb. 20, 2007

(87) PCT Pub. No.: WO2006/027587

PCT Pub. Date: Mar. 16, 2006

(65) Prior Publication Data

US 2007/0261197 A1 Nov. 15, 2007

(30) Foreign Application Priority Data

Sep. 8, 2004 (GB) ..... 0419968.3

(51) Int. Cl.
*A47G 27/04* (2006.01)

(52) U.S. Cl. ..... 16/7

(58) Field of Classification Search ..... 16/7, 16/8, 16; 24/289–295, 297; 52/177, 459, 52/466, 656.9; 15/215, 216, 238, 239
See application file for complete search history.

(56) References Cited

U.S. PATENT DOCUMENTS 2,506,030 A 5/1950 Mapes (Continued)

FOREIGN PATENT DOCUMENTS

GB 2 115 692 A 9/1983

(Continued)

*Primary Examiner*—Victor Batson
*Assistant Examiner*—Matthew Sullivan
(74) *Attorney, Agent, or Firm*—Lerner, David, Littenburg, Krumholz & Mentlik, LLP

(57) ABSTRACT

A fastener for fixing an edge portion of a resilient material to a surface comprising a base element fixed in use to a surface, and a removable clip element, in which the clip element is provided with a first part of engagement means, and the base element is provided with a second part of engagement means, in which in use a resilient material is disposed adjacent the base element such that when the first part and the second part of the engagement means are aligned for engagement in use a portion of the clip element extends over an edge portion of the resilient material, in which in use said portion of the clip element is applied to said edge portion of the resilient material with a compression force, in which said compression force is required in order to engage said engagement means, and in which once the engagement means is engaged the compression force is removed and an extension force applied by the resilient material to said portion of the clip element forces said engagement means into engagement, in which the engagement means can only be disengaged when said compression force is applied to said portion of said clip element, and in which in use the clip element extends from the surface, over the base element, and onto the resilient material.

17 Claims, 6 Drawing Sheets

U.S. PATENT DOCUMENTS

| | | | | | |
|---|---|---|---|---|---|
| 2,875,467 | A | | 3/1959 | DeVault | |
| 2,996,751 | A | | 8/1961 | Roby et al. | |
| 3,435,481 | A | * | 4/1969 | Kessler | 15/215 |
| 3,578,738 | A | * | 5/1971 | Hughes | 15/215 |
| 3,710,414 | A | | 1/1973 | Fuller et al. | |
| 4,138,808 | A | * | 2/1979 | Walkiewicz, Jr. | 52/459 |
| 5,732,760 | A | * | 3/1998 | Pattison | 160/371 |
| 6,745,534 | B2 | * | 6/2004 | Kornfalt | 52/468 |
| 6,757,945 | B2 | * | 7/2004 | Shibuya et al. | 24/662 |
| 7,043,792 | B2 | * | 5/2006 | Kessler | 15/215 |
| 2003/0154678 | A1 | * | 8/2003 | Stanchfield | 52/468 |

FOREIGN PATENT DOCUMENTS

| | | | | |
|---|---|---|---|---|
| GB | 2250192 | A | * | 6/1992 |

* cited by examiner 50
53
58
54
71
55
54a
59
60
56
51
65
63
62
64
66
70
57
61

68
71
58
67
70
52
69

A 53
70
72
68
55
52
57
51
58

53
56
72
68
55
52
73
74
57
60
51
54
69

40
41
42
43
44

42
46
48
47
44
45
48
46
42

80
81
83
84
85
86
82
86

83
84
87
88
89
90
89
88
87

89
51
86
62
56
69

FASTENER FOR FIXING AN EDGE PORTION OF A RESILIENT MATERIAL TO A SURFACE

This Invention relates to a fastener for fixing an edge portion of a resilient material to a surface, for use particularly, but not exclusively, to secure matting to a floor.

Matting is commonly provided at entrance ways to public or commercial spaces, for example hotel lobbies, shop foyers or office blocks. Such matting can function to prevent dirt and moisture from getting inside the building, and can provide a safe non-slip environment for users passing over it.

This kind of commercial matting is designed to be very hard wearing because it is subjected to high levels of use, for example more than 5,000 crossings a day. To be effective the matting must be secured fast to the surface it Is laid on to prevent it working loose. If matting does come loose this can be unsightly and can foul doorways and other constructions. In addition, a loose matt can be a safety hazard to pedestrians as there is a risk of slipping, and can cause problems for wheelchair users.

One particular problem can occur when wheelchairs, or wheeled trolleys or the like, are driven onto a matting which Is laid on top of a flooring surface. The force of a loaded wheel rolling onto a matting can cause the matting to ride upwards and become dislodged. In order to prevent such an occurrence, matting can be provided with an edging profile, or trim around its edges to assist wheelchairs or trolleys onto the matting.

Therefore, known methods of securing matting in place are primarily designed to prevent the matt becoming dislodged, and as a result it can be a difficult task to lift matting for cleaning or fitting a replacement.

Gripper bars with protruding vertical spikes are commonly used to hold the edges of matting, and matting can also be glued down. Lifting matting when it Is secured In this way often damages the material, and can be an awkward task.

In some arrangements matting Is laid into a trough which has been prepared for the purpose, and the matting is secured therein with gripper bars or permanent fasteners. Such an arrangement benefits from a reduced risk of the matting coming loose, but Is expensive to prepare. To remove the matting the fasteners must be pulled up, and if the matting is replaced new fasteners must be used. Obviously, such a procedure is time consuming and costly.

It is now desired to regularly replace matting and to provide a means to hold matting firmly in place, which can be readily released and applied.

Therefore, according to the present Invention a fastener for fixing an edge portion of a resilient material to a surface comprises a base element fixed in use to a surface, and a removable clip element, in which the clip element is provided with a first part of engagement means, and the base element is provided with a second part of engagement means, in which in use a resilient material is disposed adjacent the base element such that when the first part and the second part of the engagement means are aligned for engagement in use a portion of the clip element extends over an edge portion of the resilient material, in which In use said portion of the clip element is applied to said edge portion of the resilient material with a compression force, in which said compression force is required in order to engage said engagement means, and in which once the engagement means is engaged the compression force is removed and an extension force applied by the resilient material to said portion of the clip element forces said engagement means into engagement, in which the engagement means can only be disengaged when said compression force is applied to said portion of said clip element, and in which in use the clip element extends from the surface, over the base element and onto the resilient material.

(References to the physical structure of the fastener in the Statement of Invention above, and in the following description are to be understood in relation to a cross-section of the fastener. For example, in the description below the clip element is described as having an arcuate shape extending from a first end to a second end. This definition relates to the cross-section of the clip element, and not to its general structure, which is preferably a long extrusion.)

In a preferred arrangement the first part of the engagement means can, comprise a substantially L-shaped lug extending from an underside of the clip element, and the second part of the engagement means can comprise a catch adapted to engage with the lug The engagement means can be so arranged that the lug must be brought under the catch, by means of the compression force, and also moved laterally towards the catch for engagement therewith. As a result the extension force forces the lug into engagement with the catch in use.

Therefore, the engagement means can only be disengaged when said compression force is applied, along with a lateral movement opposite to that required to engage the engagement means.

The first part of the engagement means can further comprise an abutment extending from the underside of the clip element at a second end of the clip element, which second end is opposite to the portion of the clip element which extends over the resilient material in use. (The portion of the clip element which extends over the resilient material in use can end at a first end of the clip element.) In addition, the second part of the engagement means can further comprise a lip which is spaced apart from the catch and which is in front of the abutment when the lug and the catch are engaged as described above.

Therefore, when the lug is disposed under the catch, the lip can engage the abutment by being in front of it, and therefore prevent the clip element moving towards the resilient material and allowing the catch to release the lug In use when the lug is disposed under the catch, and the extension force is applied to the first end of the clip element to force the lug into engagement with the catch, as described above, the clip element rotates about the lug and catch, and the extension force is converted into a second compression force applied to the second end. This second compression force forces the abutment into position behind the lip.

A pivot arm can be provided on the underside of the clip element between the lug and the resilient material. The pivot arm can extend below the level of the lug, but can be spaced apart from the surface when the extension force is applied as described above.

The pivot arm has two functions. In use when the clip element is engaged with the base element and the lug and catch, and the abutment and lip are engaged, if a compression force is applied to a top side of the clip element, for example by a user stepping on it, this would force the clip element down into the resilient material, and disengage the lug from the catch. The engagement of the abutment and lip would prevent the clip element working lose, but this movement of the clip element would be undesirable. Therefore, the pivot arm prevents the clip element moving down any further than the distance that the pivot arm is spaced form the surface when the extension force is applied.

The second, and principal, function of the pivot arm, is to facilitate ready removal of the clip element from the base element. To disengage the abutment from the lip a compression force is applied to the portion of the clip between the pivot arm and the first end. The compression force disengages the lug from the catch, and brings the pivot arm into engagement with the surface. Once the pivot arm engages the surface, the clip element can be rotated about the pivot arm to raise the second end and disengage the abutment from the lip by raising It Once this is achieved a lateral force can be applied to the clip element and the lug can be moved out from under the catch, and the clip element can be removed.

Therefore, in use any forces applied to the portion of the clip element between the pivot arm and the second end will only force the clip element into engagement with the base element, and any compression forces applied to the portion of the clip element between the pivot arm and the first end will not disengage the clip element unless an additional lateral force is applied. It will be appreciated that this lateral force could readily be applied by hand, but not by any object which passes over the fastener in use.

In an alterative construction no pivot arm as such is provided, and instead the lug can be so shaped that the functions of the pivot arm described above, can be provided by an underside of the lug itself.

The base element can comprise a base provided with fixing means, an end wall at a first end, the lip at a second end, and the catch extending from a top side. In use the fixing means can be used to fix the base to the surface. The fixing means can be apertures adapted to co-operate with screws or bolts. In use the end wall can abut the resilient material, and thereby define its position in relation to the clip element (Therefore, when the pivot arm, (or the lug itself) is brought down in use as described above, it contacts the base and not the surface, and can slide thereon between the catch and the end wall.)

The clip element can be substantially arcuate in shape, and the top side can be provided with grip ribs. The grip ribs can prevent user slippage in use, and can assist the application of the lateral force needed to engage and disengage the clip element as described above.

The lug can be provided with an angled guide means at its free end adapted to co-operate with the catch. The guide means can be a guide plate which extends downwards from the end of the lug at an angle, or the lug can be so shaped that its free end comprises an angled guide face. The catch can be provided with an angled end adapted to cooperate with the guide means. The fastener can be so shaped and dimensioned that when the clip element is laid on top of, or situated above, the resilient material ready for the compression force to be applied, the guide means can engage the angled end of the catch. The guide means and the angled end can be so adapted that if a compression force and the lateral movement required for engagement as described above are applied simultaneously, the guide means will slip over the angled end until the lug engages the catch in a snap-it arrangement With this arrangement the lug does not need to be brought below the catch in a spaced-apart manner, rather a lesser compression force can be applied and the lug can be guided into position and can slide under the catch until the abutment passes beyond the lip and slots into position.

The catch can be provided with a support arm which is angled at substantially the same angle as the guide means, such that the guide means does not foul the catch when the fastener is engaged.

It will be appreciated that as the fastener is not resilient, it will only work with a predetermined resilient material, which has a known height and resilient compression properties. Therefore, the clip-element can be so dimensioned and shaped that it engages the resilient material in the correct manner. Therefore, only a second resilient material of the same height and resilient compression properties can replace the resilient material if it is removed.

It has been found in practice that the invention described above can work less well with some resilient materials with a comparatively greater height, for example over 1 cm, or with a comparatively greater resilience.

Therefore, in one embodiment the first end of the clip element can be provided with a spike element extending downwards, which is adapted to grip the resilient material. In addition, the resilient material can be spaced apart from the end wall of the base element prior to engagement of the clip element, a distance approximately equivalent to the lateral distance the clip element needs to move to engage with the base. Therefore in use the clip element can be positioned over the resilient material prior to engagement and the spike element can engage the resilient material, and when the compression force and the lateral motion are applied, the resilient material is moved towards the end wall.

The fastener can be provided in long strips adapted to fit around all the sides of a piece of resilient material. Both the base and the clip element can be provided with their features extending continuously from one end of a strip to the other. Preferably the base and the clip element can be constructed from a metal extrusion.

In one embodiment the base elements can be adapted to carry corner elements at each end in use. In a preferred construction the base element can be shaped to define a trough between a rear side of the support arm of the catch and the lip. The trough can be provided with upper flanges at each upper edge. In use a key arm of a corner element can be slotted laterally into the trough at an end of a strip of base element With this arrangement two strips of base element can be joined together at their ends to form a frame work, which can then be secured to a surface. It will be appreciated that the trough will extend along the entire length of any strip of base element if the base element is a metal extrusion, and it will only carry a base corner element at each end thereof.

The invention also includes a fastening frame for fixing a piece of resilient material to a surface comprising a frame work of base elements fixed in use to a surface, and a framework of removable dip elements, in which the clip elements are provided with a first part of engagement means, and the base elements are provided with a second part of engagement means, in which in use a resilient material is disposed within the frame work of base elements such that when the first part and the second part of each engagement means are aligned for engagement in use a portion of each clip element extends over an edge portion of the resilient material, in which in use said portion of each clip element is applied to each of said edge portions of the resilient material with a compression force, in which said compression force is required in order to engage each of said engagement means, and in which once each engagement means is engaged the compression force is removed and an extension force applied by the resilient material to said portion of each clip element forces each of said engagement means into engagement, in which each engagement means can only be disengaged when said compression force is applied to said portion of each clip element, and in which in use each clip element extends from the surface, over the corresponding base element and onto the resilient material.

In a preferred construction the frame work of base elements can comprise three or more elongate strips and three or more corner elements, and the frame work of clip elements can comprise three or more corresponding elongate strips.

In one construction the corner elements can comprise a base corner element and a clip corner element The base corner elements can be fixed in use to the surface and can be arranged at the corners of the framework of base elements. The clip corner elements can be adapted to be fastened to the base corner elements and can be provided with portions at each end which extend over the clip elements after the clip elements have been engaged with the base elements in use, thereby to hold the clip elements in position. This type of corner element can be used with constructions in which no trough is provided on the base element.

However, in an alternative construction the corner elements can comprise singular units provided with key arms extending from each side, which are adapted to slot into troughs provided on the base elements, as described above. With this arrangement the base elements can be joined together with the corner elements, then secured to the surface. As such the corner elements are held in place and cannot be removed.

The Invention can be performed in various ways, but four embodiments will now be described by way of example and with reference to the accompanying drawings in which.

Figure 1:
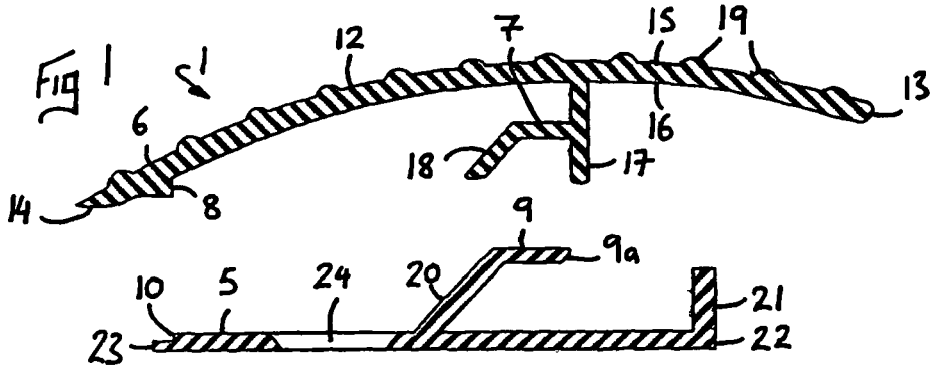
FIG. 1 is a cross-sectional view of a fastener according to the present invention.
Figure 2:
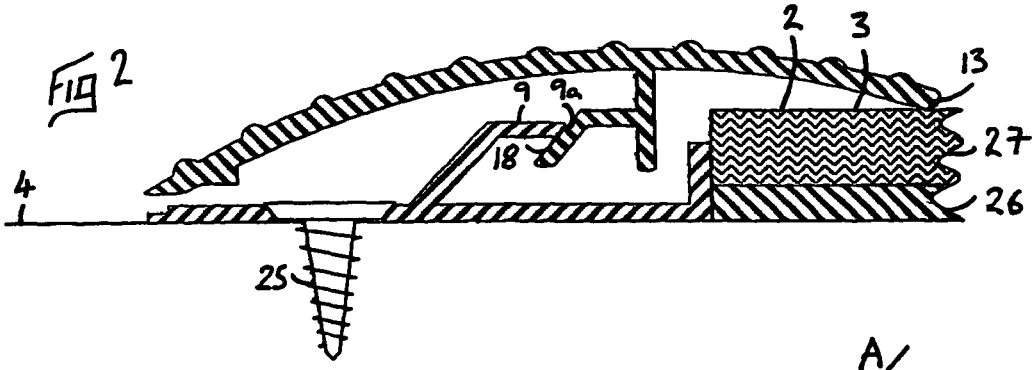
FIG. 2 is a cross-sectional view of the fastener as shown in FIG. 1 in use in a first position.
Figure 3:
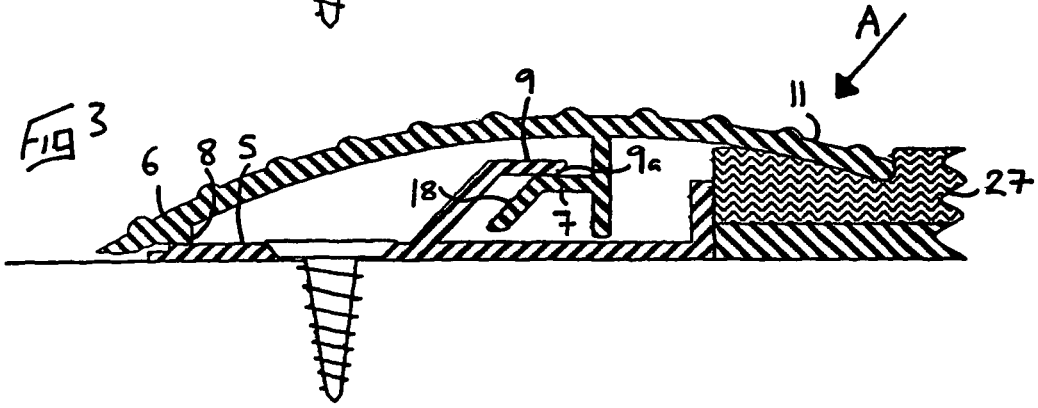
FIG. 3 is a cross-sectional view of the fastener as shown in FIG. 1 in use in a second position.
Figure 4:
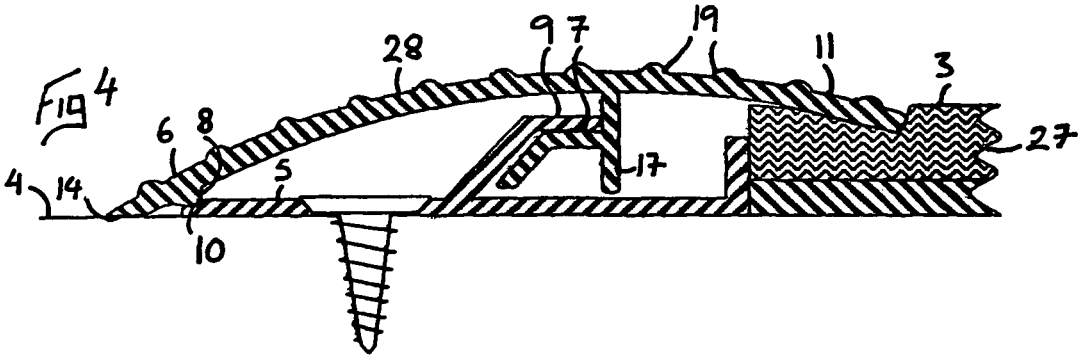
FIG. 4 is a cross-sectional view of the fastener as shown in FIG. 1 in use in a third position.
Figure 5:
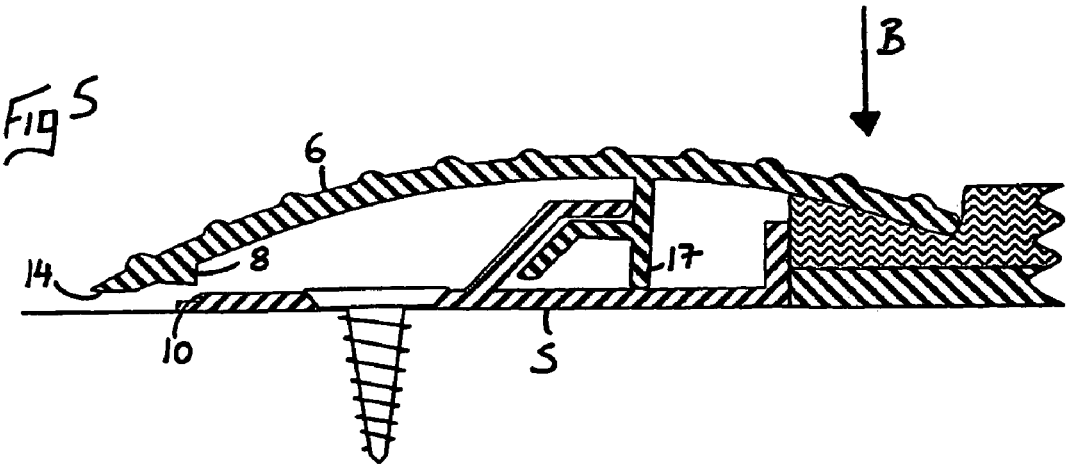
FIG. 5 is a cross-sectional view of the fastener as shown in FIG. 1 in use in a fourth position.
Figure 6:
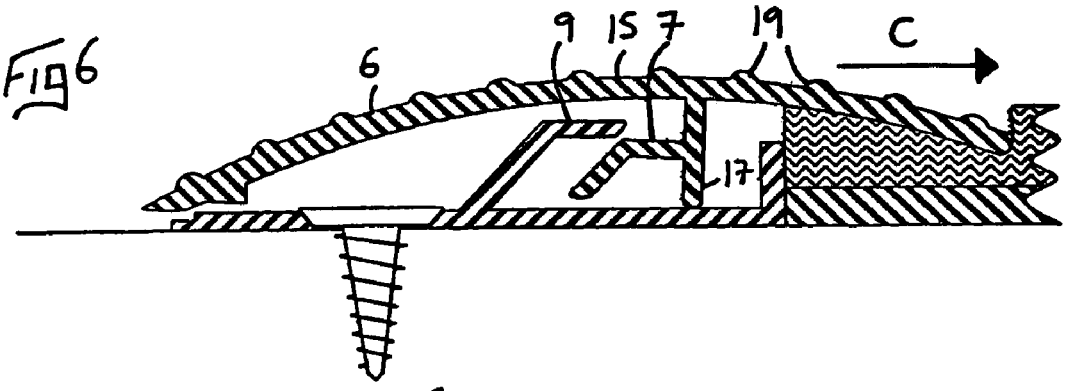
FIG. 6 is a cross-sectional view of the fastener as shown in FIG. 1 in use in a fifth position.
Figure 7:
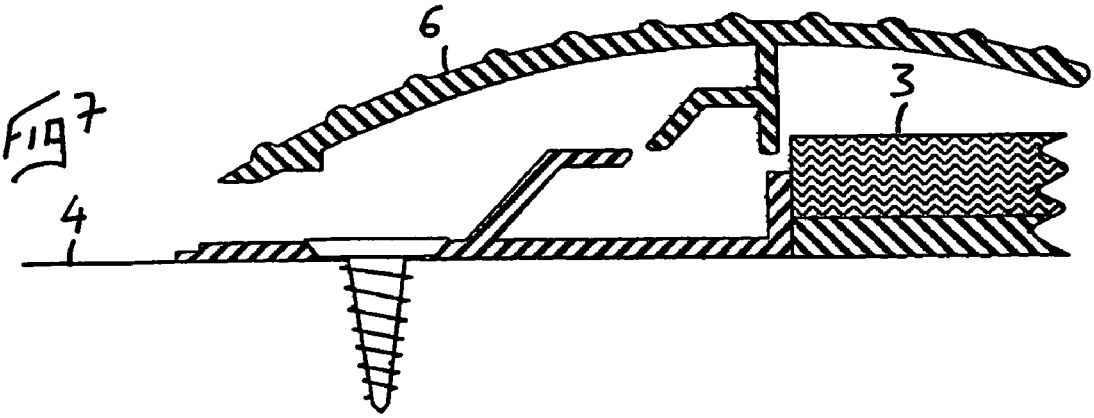
FIG. 7 is a cross-sectional view of the fastener as shown in FIG. 1 in use in a sixth position.

As shown in FIGS. 1-7 a fastener 1 for fixing an edge portion 2 of a resilient material 3 to a surface 4 comprises base element, in the form of base 5, fixed in use to a surface 4, and a removable clip element 6. The clip element 6 is provided with a first part of engagement means, in the form of lug 7 and abutment 8, and the base element (5) is provided with a second part of engagement means, in the form of catch 9 and lip 10. In use a resilient material 3 is disposed adjacent the base element (5) such that when the first part (7 and 8) and the second part (9 and 10) of the engagement means are aligned for engagement (as shown in FIG. 4) in use a portion 11 of the clip element 6 extends over an edge portion 2 of the resilient material 3. In use said portion 11 of the clip element 6 is applied to said edge portion 2 of the resilient material 3 with a compression force (as shown in FIGS. 3 and 4 and described below), in which said compression force is required in order to engage said engagement means (7, 8, 9 and 10). Once the engagement means (7, 8, 9, and 10) is engaged (as shown in FIG. 4) the compression force is removed and an extension force applied by the resilient material 3 to said portion 11 of the clip element 6 forces said engagement means (7, 8, 9 and 10) into engagement The engagement means (7, 8, 9 and 10) can only be disengaged (as shown in FIGS. 5, 6 and 7 and as described below) when said compression force is applied to said portion 11 of said clip element 6. In use (as shown in FIG. 4) the clip element 6 extends from the surface 4, over the base element (5), and onto the resilient material 3.

(FIGS. 1 to 14 show cross-sectional views of a first, second and third fastener according to the present invention. References to the physical structure of the fasteners are to be understood in relation to the cross-sectional views shown. For example, the clip element 6 has an arcuate shape extending from a first end to a second end when viewed in cross-section, however this definition would be confusing if the clip element were considered as the long extrusion shown in FIGS. 15 and 16, where the first and second end would be more accurately described as a first and second side.)

As shown in FIG. 1, the clip element 6 generally comprises an arcuate body 12 with a first end 13 and a second end 14. The body has a top side 15,and an underside 16. The lug 7 is L-shaped and extends from the underside 16. A pivot arm 17 extends below the lug 7, and the lug 7 is provided with guide plate 18. The abutment 8 also extends from the underside 16 of the clip element 6, and Is adjacent the second end 14. The top side 15 of the clip element 6 is provided with grip ribs 19 which are equally spaced along its length. The clip element 6 Is substantially non-resilient in construction, and is made from extruded steel.

The base 5 comprises catch 9, which is mounted on angled support arm 20, which is arranged at the same angle as the guide plate 18. The catch is provided with an end 9a, which is angled at substantially the same angle as the guide plate 18. The base also comprises an end wall 21 at a first end 22, and lip 10 at a second end 23. The base 5 is also provided with fixing means, in the form of countersunk screw aperture 24. In use a screw 25 is disposed in the aperture 24 thereby to hold the base 5 on the surface 4.

Therefore in use the base 5 is first secured to the surface 4 by means of screw 25, as shown in FIG. 2. Then the resilient material 3, which is in the form of commercial matting, is placed up against the end wall 21. (The commercial matting is constructed from a rubberised base material 26, and resilient fibres 27.) The first end 13 of the clip element 6 is then placed into contact with the resilient material 3, and the guide plate 18 is placed against the end 9a of the catch 9.

A compression force is then applied, preferably by hand, approximately in the direction of arrow A, as shown in FIG. 3. This compression force is a combination of a downward force and a lateral force, which acts to compress the resilient fibres 27, and force the guide plate 18 to slide over the end 9*a*. The combination of these movements forces the lug 7 to be brought under the catch 9, as shown in FIG. 3. In the position shown in FIG. 3 the resilient fibres 27 are applying an-extension force against the portion 11 of the clip element 6 which they contact This extension force forces the lug 7 against the catch 9, and this contact acts as a pivot which rotates the clip element 6 and forces the abutment 8 onto the base 5.

(It will be appreciated that the arrangement shown in FIG. 3 could also be achieved if a compression force were applied straight down onto the portion 11 of the clip element 6, such that the lug 7 were disposed beneath the level of the catch 9, then a lateral force were applied to move the lug 7 under the catch 9. However, the presence of the guide plate 18 allows the clip element 6 to be forced into place in one ready movement and with a lesser force required.)

Once the lug 7 reaches a level below the catch 9 in the process described above, the resistance of the end 9*a* acting against the guide plate 18 is removed. As a result, the clip element 6 can then be pushed Into the position shown in FIG. 4. The clip element 6 is pushed until the abutment 8 slides over the lip 10 and drops into place. The clip element 6 is then locked in place with the second end 14 very near or touching the surface 4.

The extension force applied by the resilient fibres 27 against the portion 11 of the clip element 6 forces the lug 7 up towards the catch 9, thereby engaging it This engagement pivots the clip element 6 and forces the abutment 8 down, and hence into position behind the lip 10. The clip element 6 therefore secures the resilient material 3 in place on the surface 4, and forms a ramp from the surface 4 onto the resilient material 3.

It will be appreciated that if any compression force is applied to a portion 28 of the clip element 6 which is between the pivot-arm 17 and the second end 14, this will act to force the abutment 8 into its position behind the lip 10, and hence prevent the clip element 6 from disengaging from the base 5. The pivot arm 17 also restricts any downward movement beyond the short distance It can travel before it contacts the base 5.

Any compression force applied to the rest of the clip element 6, being that part between the pivot arm 17 and the first end 13, may act to force the pivot arm 17 into engagement with the base 5 and possibly raise the abutment 8 up from behind the lip 10, but the clip element 6 will stay in position because a lateral force is required to pull the lug 7 out from under the catch 9. Therefore, when normal forces which are applied to a flooring are applied to the fastener 1 in the position shown in FIG. 4, the clip element 6 will not normally disengage from the base 5. In use the grip ribs 19 act to prevent slippage of any users.

The process by which the clip element 6 is removed from the base 5 is shown in FIGS. 5, 6, and 7. Firstly, a compression force is applied in the direction of arrow B, preferably by hand. As a result the pivot arm 17 is pushed down onto the base 5, and the clip element 6 pivots about the pivot arm 17, raising the second end 14 and lifting the abutment 8 above the lip 10, as shown in FIG. 5.

A lateral force is then applied to the top side 15 of the clip element 6, in the direction of arrow C, as shown in FIG. 6. Again, this can be applied by hand, and can be assisted by the grip ribs 19. The lateral, or pulling, force is applied until the clip element 6 has slid on the pivot arm 17 until it reaches the position shown in FIG. 6, wherein the lug 7 is no longer underneath the catch 9. The compression force is then removed, and the clip element 6 can be removed, as shown in FIG. 7. The resilient material 3 can then be removed from the surface 4 for replacement It will be appreciated that as the fastener 1 is substantially not resilient, it will only work with a predetermined resilient material with a known height and resilient compression properties, which in the case of fastener 1 is resilient material 3. This is a deliberate feature to prevent the fastener 1 being used with competitor's matting.

Therefore, each different type of matting supplied requires a fastener which Is shaped and dimensioned to operate with it.

Figure 8:
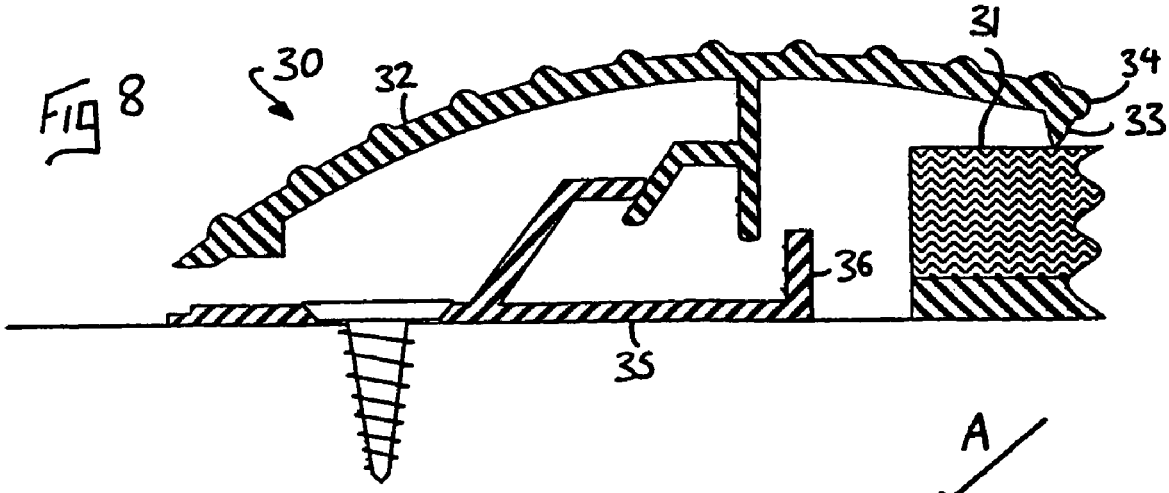
FIG. 8 is a cross-sectional view of a second fastener according to the present invention, in use in a first position.
Figure 9:
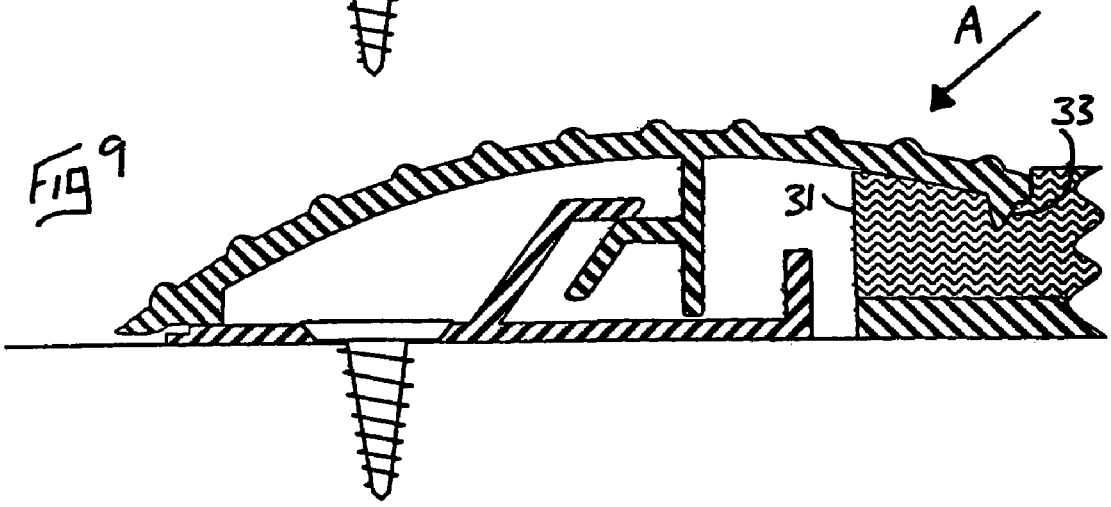
FIG. 9 is a cross-sectional view of the fastener as shown in FIG. 8 in use in a second position.
Figure 10:
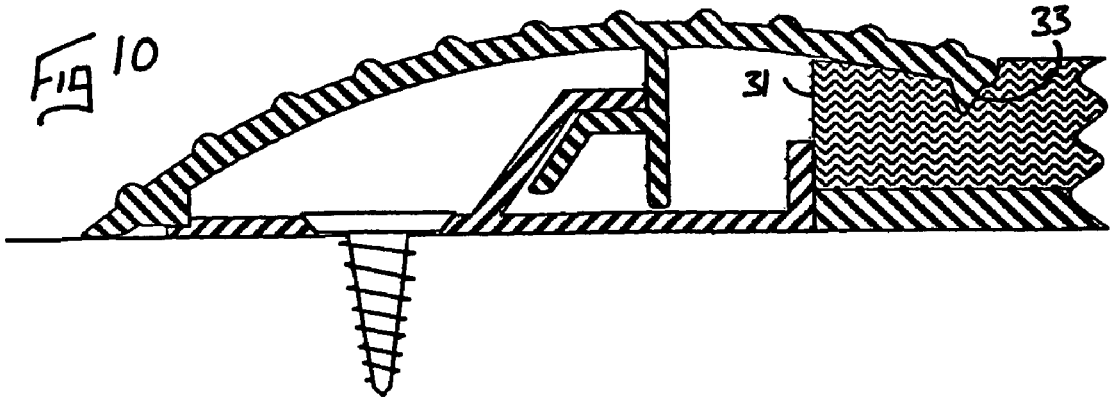
FIG. 10 is a cross-sectional view of the fastener as shown in FIG. 8 in use in a third position.
Figure 11:
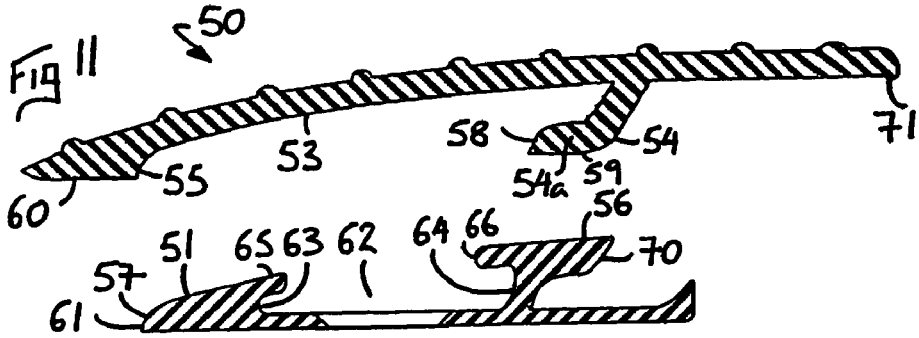
FIG. 11 is a cross-sectional view of a third fastener according to the present invention.

In FIGS. 8, 9 and 10 a second fastener 30 is similar in construction to fastener 1, and operates in substantially the same way, but it is shaped and dimensioned to work with resilient matting 31, which has a greater height than resilient material 3. The clip element 32 is therefore greater in height than clip element 6, and the rest of the components of the fastener 30 are also larger in size than their equivalents in fastener 1.

Clip element 32 is provided with spike element 33 at the first end 34 which provides further grip of the resilient material 31. It will be appreciated that spike element 33 prevents the clip element 32 from sliding across the resilient material 31, as is the case with fastener 1 described above. Therefore, the clip element 32 Is applied to the resilient material 31 and the base 35 in a different manner.

As shown in FIG. 8, the resilient material 31 is placed in a spaced apart relationship from end wall 36. The gap between the end wall 36 and the resilient material 31 is approximately the same as the distance the clip element 32 travels laterally in the engagement process.

A compression force is then applied in the direction of arrow A and the clip element 32 engages the base 35 in the same way as in fastener 1. However, as the clip element 32 moves laterally, it pulls the resilient material 31 towards the end wall by virtue of the spike element 33, as is clear from FIGS. 9 and 10. When the clip element 32 is removed, the resilient material 31 moves back in a reverse of the process shown in FIGS. 8, 9, and 10.

FIGS. 11 to 14 show a third embodiment of the present invention which operates in a similar manner to fasteners 1 and 30 described above, however it has a more ergonomic shape which means that some features operate in a different way, and it has some significant extra features.

As shown in FIGS. 11 to 14, fastener 50 comprises base 51, which is fixed in use to a surface 52, and a removable clip element 53. The clip element is provided with lug 54 and abutment 55, and the base 51 is provided with catch 56 and lip 57, however these components are somewhat different to those described above.

In particular, lug 56 is merely L-shaped and does not have a guide plate or pivot arm as such extending therefrom. Instead, the lower section 54*a* of lug 54 is thicker, and has guide face 58 and underside 59, which perform the functions of the guide plates and pivot arms described above.

Likewise, the abutment 55 and lip 57 are of a simpler and more ergonomic shape, but function the same as those described above. Abutment 55 extends all the way to the end 60 of the clip element 53, and is curved in shape. In addition, the lip 57 comprises the end 61 of the base 51, and is also curved in shape.

A significant extra feature in fastener 50 is that it is so shaped as to define trough 62. The trough 62 is formed by wall 63, the support arm 64 of the catch 56, and flanges 65 and 66 extending therefrom. The trough 62 is adapted to co-operate with the key arm of a corner element, as described below in relation to FIGS. 17 to 19.

Figure 12:
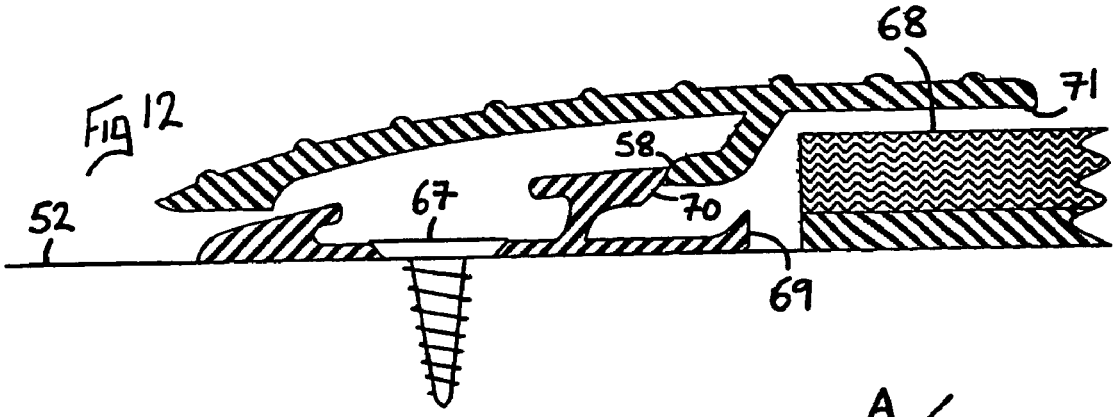
FIG. 12 is a cross-sectional view of the fastener as shown in FIG. 13 in use in a first position.
Figure 13:
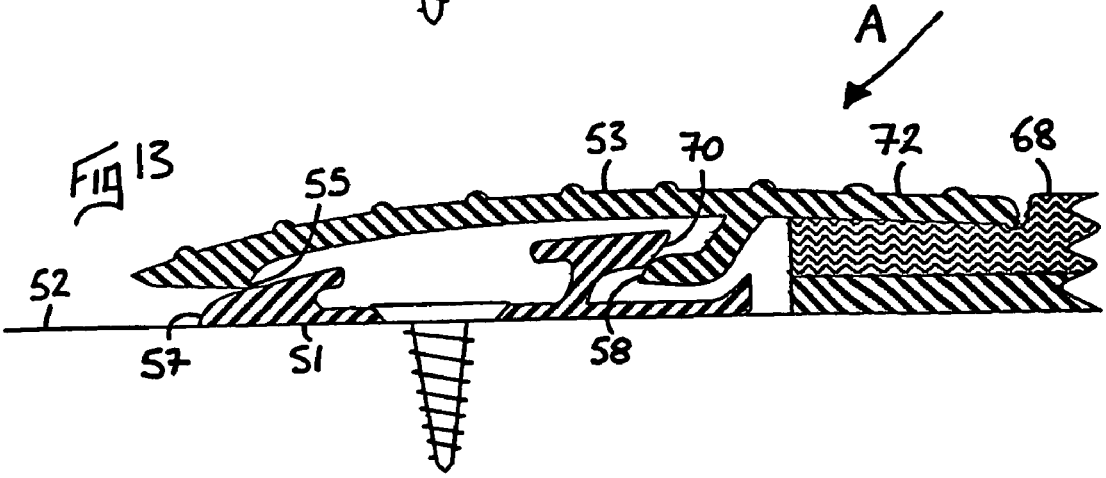
FIG. 13 is a cross-sectional view of the fastener as shown in FIG. 13 in use in a second position.
Figure 14:
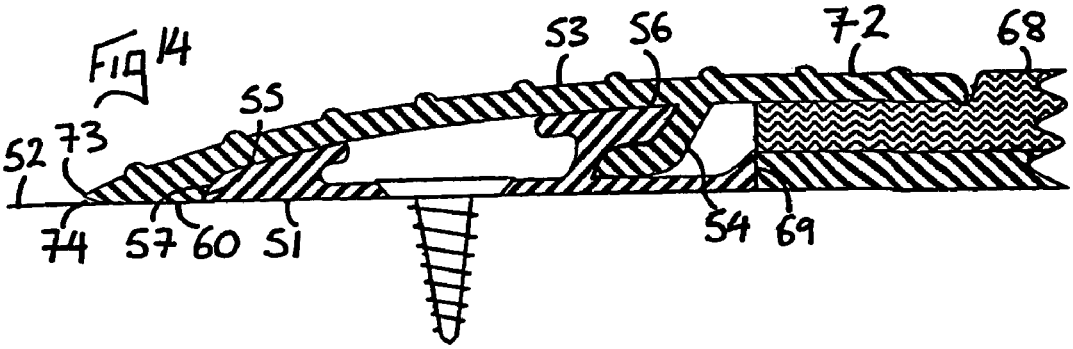
FIG. 14 is a cross-sectional view of the fastener as shown in FIG. 13 in use in a third position.

Referring to FIG. 12 to 14, in use the base 51 is first secured to the surface 52 by means of screw 67, as shown in FIG. 12. Then the resilient material 68, which is in the form of commercial matting, is placed adjacent end wall 69 of the base 51, in a spaced apart manner.

(Fastener 50 operates in a similar manner to fastener 30, in that the material 68 is spaced from the base 51 at first then drawn towards it as the fastener Is fastened, however the reason for this is slightly different to with fastener 30. The lug 54 is arranged at an angle, and when the guide face 58 contacts the angled end 70 of the catch 56, as shown in FIG. 12, the lug 54 is actually proud of the end wall 69 and could foul the material 68. In order to assist the drawing process spike element 71 is provided on the catch 53. In practice It is possible to place the material 68 against the end wall 69, and fasten the fastener 50 in the manner of fastener 1, however it does not work as smoothly as when a small gap is left.)

To fasten the clip element 53 onto the base 51, the guide face 58 is placed against the end 70 of the catch 56. A compression force is then applied, preferably by hand, approximately in the direction of arrow A, as shown in FIG. 13. This compression force is a combination of a downward force and a lateral-force, which acts to compress the material 68 and force the guide face 58 to slide over the end 70. At the same time the abutment 55 comes into contact with the shaped surface of the base 51. As the compression force is applied the clip element 53 pivots about this point of contact, as shown in FIG. 13. The combination of these movements forces the guide face 58 to slide over the end 70, so as to bring the lug 54 under the catch 56, as shown in FIG. 14.

In the position shown in FIG. 13 the resilient material 68 is applying an extension force against the portion 72 of the clip element 53 which it contacts. When the clip element 53 reaches a point somewhere between that shown in FIG. 13 and 14, when the lug 54 is under the catch 56, the extension force forces the lug 54 against the catch 56, and this contact acts as a pivot which rotates the clip element 53 in the opposite direction, and forces the abutment 55 onto the base 5S. A more lateral force can then be applied so the abutment 55 slots into position behind the lip 57, and the end 60 contacts the surface 52. As this occurs the material 68 is drawn into position against the end wall 69.

It will be appreciated that these movements happen in quick succession in a single action.

The extension force applied by the resilient material 68 against the portion 72 of the clip element 53 forces the lug 55 up towards the catch 56, thereby engaging it This engagement pivots the clip element 53 and forces the abutment 55 down, and hence into position behind the lip 57. The clip element 53 therefore secures the resilient material 68 in place on the surface 52, and forms a ramp from the surface 52 onto the resilient material 68.

As with fasteners 1 and 30, any compression force applied in use to the clip element 53 between the lug 54 and the end 60 acts to force the abutment 60 into its position behind the lip 57, and hence prevent the clip element 53 from disengaging from the base 51.

Any compression force applied to the rest of the clip element 53, being that part between the lug 54 and the spike element 71 may push the lug 54 into contact with the base 51, and act to rotate the clip element 53 about the lug 54 and lift the abutment 55 away from the lip 57. However, the tolerances in fastener 50 are far less than in fasteners 1 and 30, and the resilient material 68 is compressed to a greater extent As a result a comparatively large force, or more than would be experienced in normal use, would be required to achieve this rotation. In addition, even if this were to occur, a lateral force would also be required to disengage the lug 54 from the catch 56.

Fastener 50 is also disengaged in a slightly different manner to fasteners I and 30 described above. In order to disengage the clip element 53 from the base 51 it is necessary to rotate the clip element 53 about the lug 54, as referred to above. However, due to the higher tolerances in this case, it is not easy to do this by applying a compression force directly to the portion 72 from above, although It may be possible. Instead, a tool (not shown) is used to lift the end 60. As is shown in the Figures end 60 tapers to a point 73, such that a small gap 74 is left under the end 60 when the clip element 53 is fastened in place. Thus, a tool (not shown) is inserted into the gap 74, and the end 60 is lifted up until the abutment 55 moves out from behind the lip 55, and a lateral force can be applied to remove the clip element 53 from the base 5t Thus, the "compression force" required to disengage the fastener 50 is applied indirectly to portion 72 by means of rotating the clip element 53 about the lug, as opposed to pushing down on portion 72 from above.

As stated above, fasteners 1, 30 and 50 have been described in cross-section. It will be appreciated that fasteners 1, 30 and 50 can be provided in any length. Preferably a fastener, or a frame work of fasteners, can be provided which grips a resilient material all the way around its edge.

Figure 15:
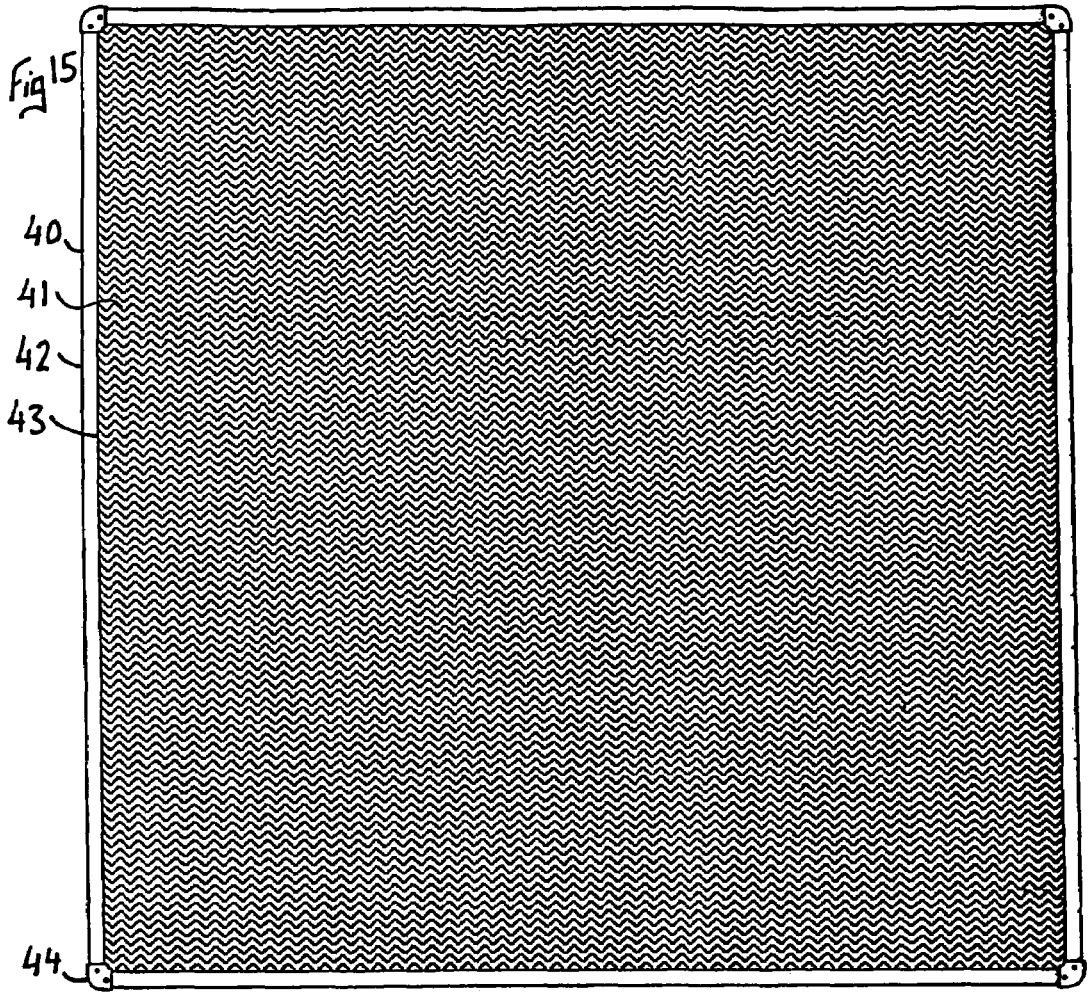
FIG. 15 is a top view of a fastening frame according to the present invention.
Figure 16:
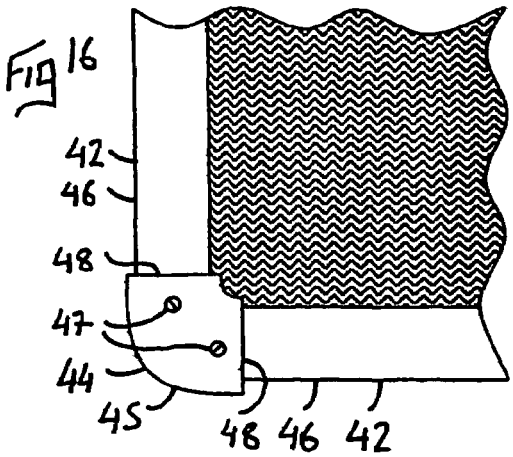
FIG. 16 is a top view of a section of the fastening frame as shown in FIG. 11.

Therefore, FIGS. 15 and 16 show a fastening frame 40 for forming a piece of resilient material, in the form of resilient mat 41, to a surface. The frame is made up of four elongate fasteners 42, identical in construction to fasteners 1 described above. Each fastener 42 extends along one edge 43 of the resilient mat 41 and grips it in use. The frame 40 is provided with corner elements 44, which are mounted between the fasteners 42 at their ends.

As shown in FIG. 16, corner elements 44 comprise a base corner element (not visible) and a clip corner element 45. The base corner elements 44 are secured to the surface by screws, and have two 90 degree opposed end walls (not visible) which abut against the ends of the bases (not visible) of the fasteners 42.

In use the clip elements 46 of the fasteners 42 are engaged in the process as described above, and the resilient mat 41 is held in place. Then the clip corner elements 45 are mounted on the base corner elements and secured thereon by screws 47. The clip corner elements are provided with lip portions 48 at each end which extend over the fasteners 42 and act as another means by which the clip elements 46 of the fasteners 42 are held down in use. The corner elements 44 are constructed from a moulded plastics material.

Figure 17:
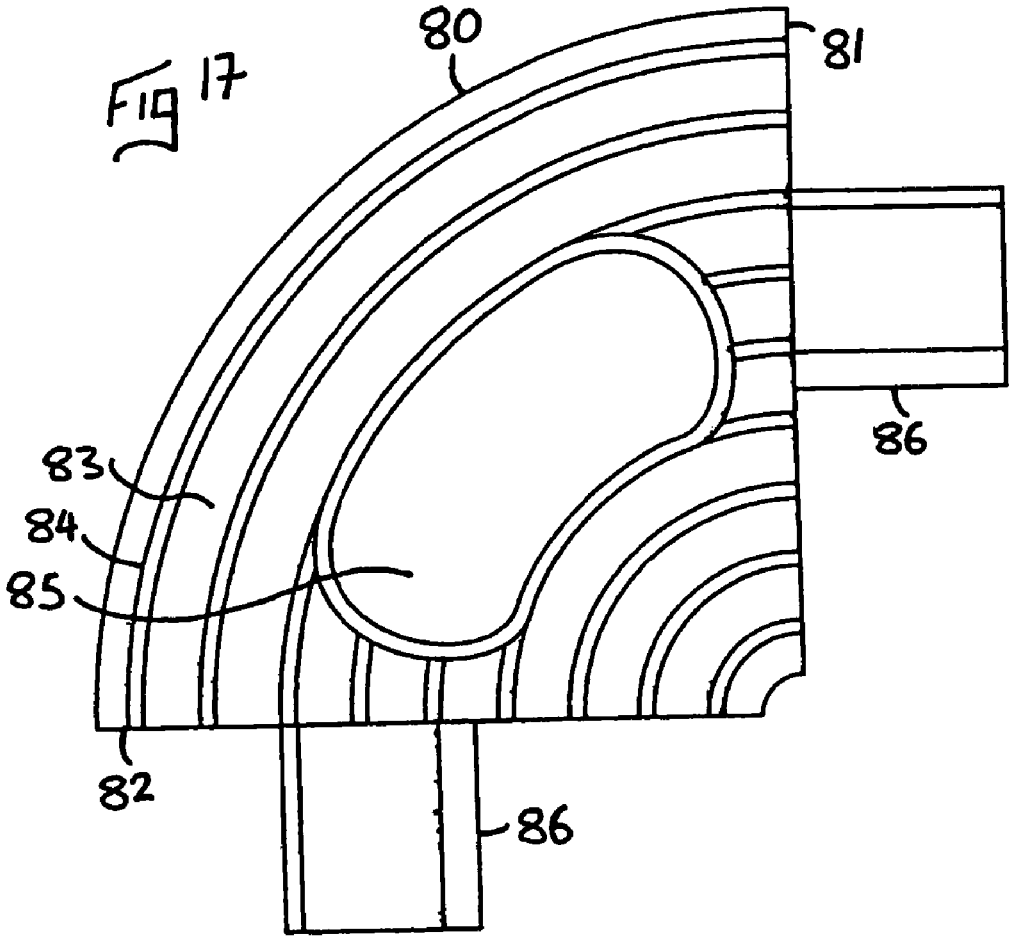
FIG. 17 is a top view of a corner element for use with a fastening frame according to the present invention.
Figure 18:
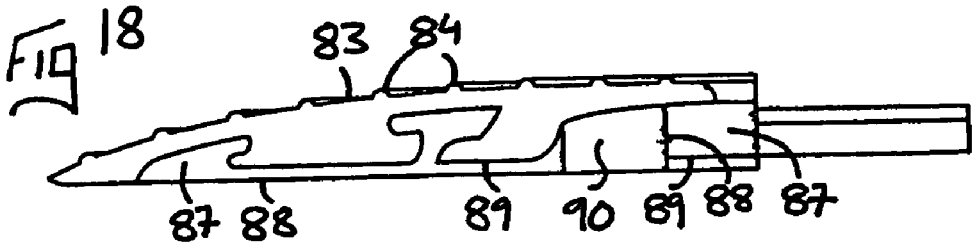
FIG. 18 is a side view of the corner element as shown in FIG. 17.
Figure 19:
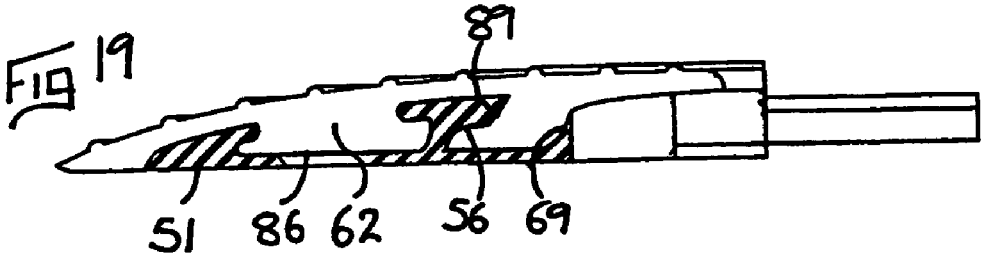
FIG. 19 is a part cross-sectional view of the corner element as shown in FIG. 17 in use.

As mentioned above, a different corner element arrangement to that described above is employed with fastener 50. Therefore, FIGS. 17 to 19 show a corner element 80 for use in a framework in which fastener 50 is used. Corner element 80 has two 90 degree opposed end walls 81 and 82, and a top surface 83 provided with grip ribs 84. The top surface 83 is also provided with a display surface 85 for carrying indicia.

Extending from each end wall 81 and 82 is a key arm 86. As is clear from FIGS. 18 and 19, the key arms 86 are so shaped as to slot into the trough 62 formed in the base 51 of fastener 50. In addition, each end wall 81 and 82 is provided with a socket 87 which ends at inner end wall 88. The key arms 86 extend from the inner end wall 88, as does a lug 89, which is shaped to slot into the space formed between the catch 56 and the end wall 69 of the base element 51, as is clear from FIG. 19. However, the lugs 89 do not extend beyond the end walls 81 and 82, and are disposed entirely within the sockets 87. A corner socket 90 is formed between the sockets 87, into which the corner of a matting is slotted in use. The corner element 80 is constructed from a moulded plastics material.

Thus, in use the base elements (51) are cut to length and a base frame work Is constructed by joining the base elements (51) together using the corner elements 80. The key arms 86 are slotted Into the troughs 62, and the lugs 89 are slotted into the space between the catch 56 and the end wall 69. This base frame work is then secured to a surface using screws. Thus, the corner elements 80 are held in position and cannot be removed. The matting is then placed inside the frame work, with Its corners slotted into the corner sockets 90. The clip elements (53) are then placed over the base elements (51) between opposite corner elements 80, and fastened In place.

The embodiments described above could be altered without departing from the spirit of the Invention. For example, in alterative embodiments (not shown), fasteners are provided in non-elongate form, for example a few cm wide, which merely hold a small portion of an edge of a resilient material. With this arrangement the clip elements can be slid out sideways from the base elements, which means that no pivot arm need be provided to assist release. In addition, it will be appreciated that alterative embodiments (not shown) can be provided which are shaped and dimensioned to hold other resilient materials in place on a surface, for example paper, cardboard, rubber or any other desired material.

Thus a fastener is provided which secures a resilient material to a surface in a highly expedient manner, but which can be released very readily. Therefore, the fastener allows matting to be regularly replaced with minimum fuss, and with no damage caused to the matting. In addition, a means is provided to secure matting which is low in manufacturing cost, and which reduces the cost of fitting matting on site. In particular, there is no need to prepare a trough to receive matting, and no need to use awkward gripper spikes or adhesive.

The invention claimed is:

1. A fastener for fixing an edge portion of a resilient material to a surface comprising a base element fixed in use to a surface, and a removable clip element adapted to be removably engaged with said base element, in which both the base element and the clip element are constructed from a substantially non-resilient material, in which the clip element comprises a first part of engagement means, and the base element comprises a second part of engagement means, in which in use a resilient material is freely removably disposed on said surface adjacent a first end of the base element in which when the first part and the second part of the engagement means are aligned for engagement in use a portion of the clip element extends over an edge portion of the resilient material, in which in use said portion of the clip element is applied to said edge portion of the resilient material with a compression force, in which said compression force is required in order to engage said engagement means, and in which once the engagement means is engaged the compression force is removed and an extension force applied by the resilient material to said portion of the clip element forces said engagement means into engagement, in which said extension force is the only force forcing the engagement means into engagement, in which the engagement means can only be disengaged when said compression force is applied to said portion of said clip element, and in which the clip element is shaped such that it extends from the uncovered surface adjacent a second end of the base element, over the base element, and onto the resilient material.

2. A fastener as claimed in claim 1 in which the first part of the engagement means comprises a substantially L-shaped lug extending from an underside of the clip element, and the second part of the engagement means comprises a catch adapted to engage with the lug in use, in which the lug must be brought under the catch and moved laterally towards the catch for engagement therewith, and in which the extension force forces the lug into engagement with the catch in use.

3. A fastener as claimed in claim 2 in which the portion of the clip element which extends over the resilient material in use ends at a first end of the clip element, and the clip element has a second end opposite to the first end, in which the first part of the engagement means further comprises an abutment extending from the underside of the clip element at said second end of the clip element, in which the second part of the engagement means further comprise a lip which is spaced apart from the catch and which is in front of the abutment when the lug and the catch are engaged in use, and in which in use the extension force rotates the clip element about the lug and catch and forces the abutment into position behind the lip such that the lug cannot be moved laterally from under the catch.

4. A fastener as claimed in claim 3 in which a pivot arm is provided on the underside of the clip element between the lug and the portion of the clip element which extends over the resilient material in use, in which the pivot arm extends below the level of the lug, and is spaced apart from the surface when the extension force is applied in use.

5. A fastener as claimed in claim 3 or 4 in which the base element comprises a base provided with fixing means, an end wall at a first end, the lip at a second end, and the catch extending from a top side, in which in use the fixing means fixes the base to the surface.

6. A fastener as claimed in claim 5 in which the clip element is substantially arcuate in shape.

7. A fastener as claimed in claim 6 in which a top side of the clip element is provided with grip ribs.

8. A fastener as in one of claims 3-4 or 6-7, in which the lug is provided with a guide plate which extends downwards from an end of the lug at an angle, in which the catch is provided with an angled end adapted to co-operate with the guide plate in use, and in which the fastener is shaped and dimensioned such that when the clip element is applied to said edge portion of the resilient material ready for the compression force to be applied, the guide plate engages the angled end of the catch.

9. A fastener as in one of claims 3-4 or 6-7, in which the lug is provided with an angled guide face at its free end, in which the catch is provided with an angled end adapted to co-operate with the guide face in use, and in which the fastener is shaped and dimensioned such that when a portion of the clip element extends over an edge portion of the resilient material in use, ready for the compression force to be applied, the guide face engages the angled end of the catch.

10. A fastener as claimed in claim 8, in which the base element is shaped to define a trough between the catch and the lip, in which said trough is adapted to receive a key arm of a corner element in use.

11. A fastener as claimed in any one of claims 3-4 or 6-7, in which the first end of the clip element is provided with a spike element extending downwards, which spike element is adapted to grip the resilient material in use.

12. A fastener as claimed in any one of claims 3-4 or 6-7, in which the second end of the clip element tapers to a point such that a small gap is left under the second end of the clip element when it is fastened to the base element in use.

13. A fastener as claimed in any one of claims 3-4 or 6-7, in which the fastener is provided in elongate strips adapted to fit around all the sides of a piece of resilient material.

14. A fastener as claimed in claim 13 in which the base element and the clip element are constructed from a metal extrusion.

15. A fastening frame for fixing a piece of resilient material to a surface comprising a frame work of base elements fixed in use to a surface, and a framework of removable clip elements, in which the clip elements are provided with a first part of engagement means, and the base elements are provided with a second part of engagement means, in which in use a resilient material is disposed within the frame work of base elements such that when the first part and the second part of each engagement means are aligned for engagement in use a portion of each clip element extends over an edge portion of the resilient material, in which in use said portion of each clip element is applied to each of said edge portions of the resilient material with a compression force, in which said compression force is required in order to engage each of said engagement means, and in which once each engagement means is engaged the compression force is removed and an extension force applied by the resilient material to said portion of each clip element forces each of said engagement means into engagement, in which each engagement means can only be disengaged when said compression force is applied to said portion of each clip element, and in which in use each clip element extends from the surface, over the corresponding base element, and onto the resilient material.

16. A fastening frame as claimed in claim 15 in which the frame work of base elements comprises three or more elongate strips and three or more base corner elements, and the frame work of removable clip elements comprises three or more corresponding elongate strips and three or more clip corner elements, in which the base corner elements are arranged in use at corners of the framework of base elements, in which the clip corner elements are fastened to the base corner elements in use, and in which the clip corner elements are provided with portions at each end which extend over the clip elements after the clip elements have been engaged with the base elements in use, thereby to hold the clip elements in position.

17. A fastening frame as claimed in claim 15 in which the frame work of base elements comprises three or more elongate strips, the frame work of removable clip elements comprises three or more corresponding elongate strips, and three or more corner elements are provided, in which the base elements are provided with a trough, in which the corner elements are provided with key arms adapted to slot into said troughs, in which the corner elements are attached to the base elements in use by means of the key arms, and in which the base elements are fastened to a surface in use.

* * * * *